United States Patent [19]

Smith

[11] Patent Number: 4,708,310

[45] Date of Patent: Nov. 24, 1987

[54] CORNER MOUNTED TRAY

[75] Inventor: Joe M. Smith, Las Vegas, Nev.

[73] Assignee: Tri-State Enterprises, Osseo, Minn.

[21] Appl. No.: 22,008

[22] Filed: Mar. 5, 1987

[51] Int. Cl.[4] ..... E04G 3/00

[52] U.S. Cl. ..... 248/220.1; 211/90

[58] Field of Search ..... 248/220.1, 235, 243, 248/247; 211/90, 134, 135, 186, 187; 108/152, 106, 107, 110

[56] References Cited

U.S. PATENT DOCUMENTS

| | | | |
|---|---|---|---|
| 764,487 | 7/1904 | Morrison | 248/220.1 X |
| 1,317,307 | 9/1919 | Mittleburg | 211/90 UX |
| 2,219,975 | 10/1940 | Bentz | 211/90 X |
| 2,340,545 | 2/1944 | Marsh | 248/220.1 X |
| 3,403,641 | 10/1968 | Baker | 108/152 |
| 4,536,995 | 8/1985 | Frederick | 248/220.1 X |

FOREIGN PATENT DOCUMENTS

| | | | |
|---|---|---|---|
| 572630 | 5/1958 | Italy | 248/220.1 |

*Primary Examiner*—J. Franklin Foss

*Attorney, Agent, or Firm*—G. Turner Moller

[57] ABSTRACT

A corner mounted tray is essentially triangular in shape and comprises a perforate bottom wall, upstanding side and front walls and is releasably attached to a vertical wall by a mortise and tenon type connection. The connection includes a relatively narrow segment adhesively affixed on the back wall thereof to the vertical wall and providing, on the front wall thereof, one or more shoulder forming elements. The side walls of the tray provide recesses for receiving the shoulder forming elements and supporting the tray thereon.

14 Claims, 4 Drawing Figures

CORNER MOUNTED TRAY

This invention relates to a corner mounted tray or shelf which is particularly adapted to be mounted in bathrooms, bath tub enclosures, shower stalls, and the like.

It is often desirable to provide temporary storage space in a bath tub enclosure, shower stall or the like. It is difficult to attach shelves, trays or the like to the slick vertical walls found in such situations. Because of limited space in a shower stall, for example, it is also difficult to attach a shelf or tray in a shower stall without seriously reducing the usable space available.

In accordance with this invention, a shelf or tray is mounted in a corner provided by a pair of generally perpendicular vertical walls. Analysis reveals that the space in a shower stall, for example, that is within about a foot of the corner is not used, i.e. that when a person uses the shower stall, he stands more than one foot from the corner.

Accordingly, the tray or shelf of this invention is positioned in the corner and is attached to the vertical walls thereof. The tray of this invention is normally attached to walls which are relatively slick and made of porcelain, organic polymeric materials or the like, the attachment is difficult to make. It is normally undesirable to use screw threaded fasteners or the like because of the damage done to the vertical wall. Adhesive attachments are accordingly indicated. It is, however, not easy to provide an attachment which has the capability of securely mounting a loaded cantilevered tray.

Disclosures of some interest relative to this invention are found in U.S. Pat. Nos. 2,219,975; 3,138,414; and 3,813,813.

In accordance with this invention, there is provided a tray which may be mounted on vertical walls meeting in a corner. The tray comprises a bottom wall and a pair of converging side walls supporting the bottom wall, the converging side walls each comprising a rectilinear recess extending from a shoulder intermediate the side walls and opening through the bottom wall to provide a passage between the bottom wall and the side walls, a vertical rib, adjacent each of the recesses, extending intermediate the ends of the recesses, and means for releasably attaching the tray to the vertical walls comprising a pair of wall brackets having a top edge abutting the shoulder and including a planar backing member sized to pass through the passage and having a back side and a front side, means integral with the backing member and extending rearwardly of the back side providing a slot of a size to receive the rib, and means for connecting each of the brackets to a vertical wall.

It is accordingly an object of this invention to provide an improved corner mounted tray or shelf.

Another object of this invention is to provide a corner mounted tray having an improved connection between the tray and the vertical walls comprising the corner.

Other objects and advantages of this invention will become more fully apparent as this description proceeds, reference being made to the accompanying drawing and appended claims.

IN THE DRAWINGS

Figure 1:
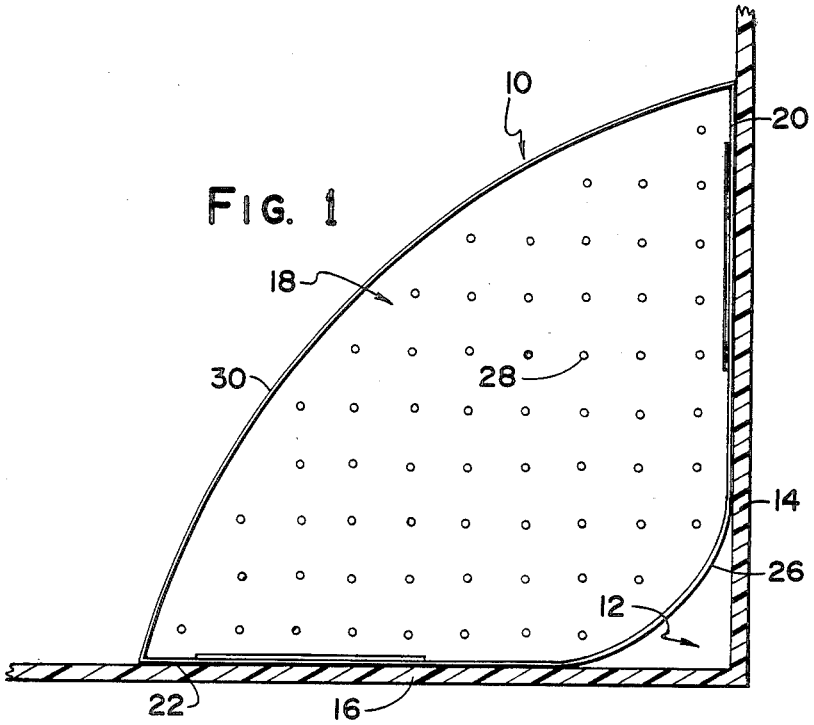
FIG. 1 is a top view of a tray of this invention mounted in a corner, the walls thereof being shown in cross-section.
Figure 2:
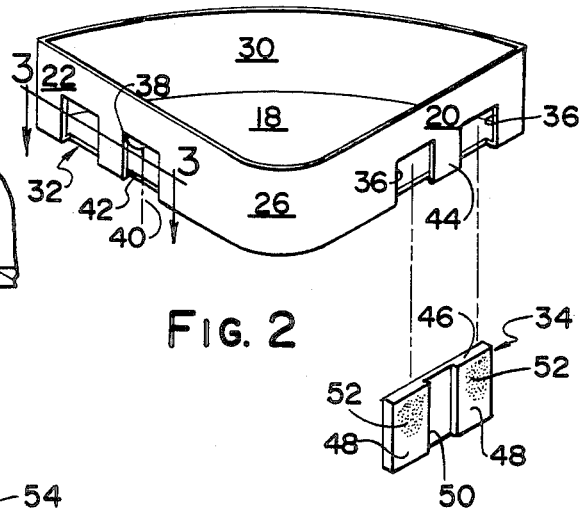
FIG. 2 is an exploded isometric rear view of the tray of FIG. 1.

Referring to FIGS. 1 and 2, a tray 10 of this invention is mounted in a corner 12 consisting of a pair of vertical perpendicular walls 14, 16. The tray 10 comprises, as major components, a bottom wall 18, first and second side walls 20, 22 and means 24 connecting the side walls 20, 22 to the vertical corner walls 14, 16.

Although the tray 10 may be made of any suitable material, it is much preferred that a injection moldable, organic polymeric material be employed.

Although the tray 10 may be of any desired shape, it is preferably generally triangular or pie shaped in which the side walls 20, 22 are generally perpendicular and meet at a rounded corner 26 having a radius substantially larger than any conventional molding. Analysis reveals that there are many different size and shape moldings used in corners and it is much preferred that the corner 26 be cut away sufficiently to avoid interference with the corner molding. To this end, the radius of the corner 26 is at least on the order of about 3" and is preferably at least 3¼".

The bottom wall 18 is accordingly a generally triangular or pie shaped segment and desirably provides a gridwork of openings 28 therethrough. Thus, the tray 10 is particularly suited for use in a corner of a bathtub enclosure, shower stall or the like where water can drain through and out of the tray 10 thereby minimizing any mold or mildew buildup in the tray 10.

The side walls 22, 24 and their junction in the corner 26 are preferably vertical and are formed integrally with the bottom wall 18. Although the tray 10 may not include a front wall 30, if desired, it is much preferred for the following reasons. Without the front wall 30, or some similar stiffening element, there is a tendency of a load in the center of the bottom wall 18 to make the wall 18 convex downwardly thereby tending to move the side walls 20, 22 away from the vertical walls 14, 16. This places the connecting means 24 in tension, tending to pull the brackets away from the vertical walls 14, 16. This is the hardest type of load for an adhesive attachment to withstand for prolonged periods. On the other hand, the front wall 30 has substantial rigidity to the tray 10 tending to stress the connecting means 24 in shear. This type load is much better handled by an adhesive.

The connecting means 24 comprises a slot 32 in each of the side walls 20, 22 and a bracket 34 secured to each of the walls 14, 16. Each slot comprises a pair of rectilinear slot segments 36 commencing at a shoulder or abutment 38 intermediate the height of the side walls 20, 22 and opening through the bottom thereof. The shoulders 38 are illustrated as perpendicular to an axis 40 of bracket movement but may be of any suitable shape. The sides of the slot segments 38 are preferably parallel to the axis 40.

Figure 3:
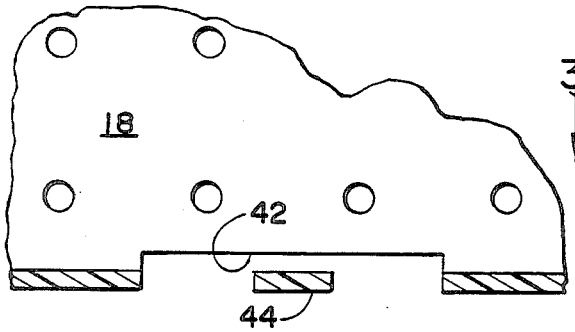
FIG. 3 is an enlarged cross-sectional view of the device of FIG. 2, taken substantially along line 2—2 thereof, as viewed in the direction indicated by the arrows.

As is evident in FIGS. 2 and 3, a notch 42 in the bottom wall 18 is coextensive with the slot 32 and extends in front of a rib 44 coplanar with the remainder of its respective side wall 20, 22. The notch 42 accordingly provides a space for receiving part of the mounting bracket 34 and separates the rib 44 from the bottom wall 18 for purposes more fully apparent hereinafter.

The mounting bracket 34 is a thin generally flat element and comprises a planar member 46 of a length slightly less than the length of the notch 42. Extending rearwardly of the rear of the planar member 46 are a pair of flat shoulder or abutment members 48 providing therebetween a slot 50 of sufficient size to receive the rib 44 therein. The mounting brackets 24 are secured to the vertical walls 14, 16 in any suitable manner, as by the provision of adhesive material 52 on the flat rear face of the members 48.

As shown best in FIG. 1, the bracket is on the order of twice as thick as the side walls 20, 22. This allows the slot 50 to be only slightly thicker than the rib 44 and yet leave substantial material spanning between the abutments 48. It will accordingly be seen that the gap between the backing member 46 and the vertical wall 14, 16, i.e. the space provided by the slot 50, fairly closely receives the rib 44 thereby providing substantial torsional rigidity for the tray 10.

Figure 4:
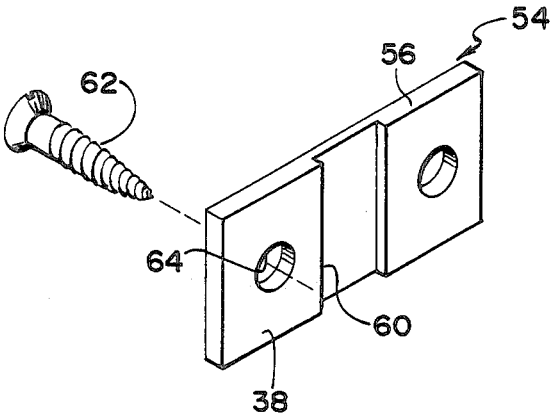
FIG. 4 is an isometric view of another embodiment of a mounting bracket usable with the device of this invention.

In the alternative, as viewed in FIG. 4, a mounting bracket 54 includes a backing member 56 of a length slightly less than the length of the notch 42. Extending rearwardly of the rear of the planar member 56 are a pair of shoulder or abutment members 58 providing therebetween a slot 60 of sufficient size the receive the rib 44 therein. The mounting brackets 54 differ from the brackets 34 and are secured to the vertical walls 14, 16 by threaded fasteners 62 extending through openings 64 in the abutment members 58.

It will accordingly be seen that the brackets 34, 54 are secured to the walls 14, 16 at an appropriate location to receive the ribs 44. The tray 10 is then position so that the slots 32 and notches 42 pass over the brackets 34, 54 and the ribs 44 pass into the slots 50, 60. The top edge of the backing members 36, 56 come to rest against the shoulders 38 thereby preventing further downward movement of the tray 10 relative to the walls 14, 16. The provision of the rib 44 in the slots 50, 60 prevents tilting movement of the tray 10 as would tend to be caused by placing a heavy article off center in the tray 10. Thus, the tray 10 is supported against the forces of gravity in the corner between the walls 14, 16 and provides a handy receptacle for articles in a shower stall, bathtub enclosure or the like.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A tray for mounting to vertical walls meeting at a corner, comprising a bottom wall and a pair of converging side walls supporting the bottom wall;

the converging side walls each comprising a rectilinear recess extending from a shoulder intermediate the side walls and opening through the bottom wall to provide a passage between the bottom wall and the side walls;

a vertical rib, adjacent each of the recesses, extending intermediate the ends of the recesses; and means for releasably attaching the tray to the vertical walls comprising a pair of wall brackets having a top edge abutting the shoulder and including a planar backing member sized to pass through the passage and having a back side and a front side;

means integral with the backing member and extending rearwardly of the back side providing a slot of a size to receive the rib; and means for connecting each of the brackets to a vertical wall.

2. The corner mounted tray of claim 1 wherein the bottom wall is pie shaped.

3. The corner mounted tray of claim 1 wherein the bottom wall is perforate.

4. The corner mounted tray of claim 1 wherein the bottom wall is generally triangular.

5. The corner mounted tray of claim 1 wherein the means for connecting the brackets to a vertical wall comprise adhesive means.

6. The corner mounted tray of claim 1 wherein the means for connecting the brackets to a vertical wall comprise an opening in the backing member and a threaded fastener extending therethrough.

7. The corner mounted tray of claim 1 wherein the converging side walls meet in a rounded corner.

8. The corner mounted tray of claim 1 wherein the converging side walls meet in a corner and further comprising a stiffening member secured to the bottom wall and spanning the distance between the side walls at a location spaced from the side wall corner.

9. The corner mounted tray of claim 8 wherein the stiffening member comprises a front wall integral with the bottom wall and both side walls and extending vertically from the bottom wall.

10. The corner mounted tray of claim 1 wherein the side walls are essentially planar in the vicinity of the recesses and each recess comprises a pair of rectilinear recess segments on opposite sides of the rib, the rib comprising a segment of the side wall coplanar with the side wall in the vicinity of the recesses.

11. The corner mounted tray of claim 10 wherein the rib is connected to the side wall adjacent an upper end of the rib and is spaced from the bottom wall adjacent a lower end of the rib.

12. The corner mounted tray of claim 10 wherein the slot providing means comprises a pair of abutments integral with and projecting from the back side of the backing member.

13. The corner mounted tray of claim 12 wherein the brackets are on the order of twice as thick as the side walls.

14. The corner mounted tray of claim 13 wherein the slot extends about half way through the bracket.

* * * * *